US005137422A

United States Patent [19]

Price et al.

[11] Patent Number: 5,137,422

[45] Date of Patent: Aug. 11, 1992

[54] PROCESS FOR PRODUCING CHROMIUM CARBIDE-NICKEL BASE AGE HARDENABLE ALLOY COATINGS AND COATED ARTICLES SO PRODUCED

[75] Inventors: Marianne O. Price, Indianapolis; John E. Jackson, Brownsburg; Jean M. Quets, Indianapolis, all of Ind.

[73] Assignee: Union Carbide Coatings Service Technology Corporation, Danbury, Conn.

[21] Appl. No.: 599,482

[22] Filed: Oct. 18, 1990

[51] Int. Cl.[5] ..... F01D 9/00

[52] U.S. Cl. ..... 415/200; 416/241 R; 29/889.71; 427/34; 427/383.7; 427/423

[58] Field of Search ..... 415/200; 416/241 R, 416/241 B; 29/889.71; 427/34, 383.7, 422, 423

[56] References Cited

U.S. PATENT DOCUMENTS

| | | | |
|---|---|---|---|
| 3,150,938 | 9/1964 | Pelton et al. | 427/423 |
| 3,729,345 | 4/1973 | Oda et al. | 416/241 B |
| 4,284,658 | 8/1981 | Davis et al. | 427/34 |
| 4,666,733 | 5/1987 | Wlodek | 427/34 |
| 4,884,820 | 12/1989 | Jackson et al. | 416/241 B |

FOREIGN PATENT DOCUMENTS

| | | | |
|---|---|---|---|
| 2816520 | 10/1979 | Fed. Rep. of Germany | 427/34 |
| 0886560 | 1/1962 | United Kingdom | 427/422 |

OTHER PUBLICATIONS

"Refractory Metal Carbide Coatings for LMFBR Applications—A Systems Approach", reprinted from Journal of Vacuum Science and Technology, vol. 12, No. 4, Jul./Aug. 1975, pp. 777–783, T. A. Wolfla and R. N. Johnson.

"Development of Several New Nickel Aluminide and Chromium Carbide Coatings for Use in High Temperature Nuclear Reactors", T. A. Taylor et al., International Conference on Metallurgical Coatings, Apr. 18–22, 1983.

"Plasma and Detonation Gun Applied Coatings—Design Alternatives to Reduce Friction and Wear", T. A. Wolfla et al., International Conference on Liquid Metal Technology in Energy Production, May 3–6, 1976.

"Sodium Compatibility Studies of Low Friction Carbide Coatings for Reactor Application", G. A. Whitlow et al., Westinghouse Electric Corporation, Madison, PA., International Corrosion Forum Mar. 4–8, 1974, paper No. 17, pp. 1–9.

*Primary Examiner*—Edward K. Look
*Assistant Examiner*—Christopher M. Verdier
*Attorney, Agent, or Firm*—Cornelius F. O'Brien

[57] ABSTRACT

An improved erosion resistant coating for a gas path component of a turbo machine which comprises the thermal spraying of a chromium carbide, such as $Cr_3C_2$, and an age hardenable nickel base alloy, such as Inconel 718, onto the gas path component and then, preferably, heat treating the deposited coating to harden the coating.

13 Claims, No Drawings

PROCESS FOR PRODUCING CHROMIUM CARBIDE-NICKEL BASE AGE HARDENABLE ALLOY COATINGS AND COATED ARTICLES SO PRODUCED

FIELD OF THE INVENTION

This invention relates to an improved erosion resistant coating for turbo machine gas path components comprising thermal spray depositing a chromium carbide and an age hardenable nickel base alloy on the surface of gas path components and then preferably heat treating the gas path components.

BACKGROUND OF THE INVENTION

Chromium carbide-nickel base alloys are known in the art as coatings to combat high static coefficients of friction and high wear rates of 316 stainless steel components in the core of sodium cooled reactors. The coatings for such application have to withstand high neutron irradiation, be resistant to liquid sodium, have thermal shock resistance and have good self-mating characteristics in terms of coefficient of friction and low wear rates. The published article titled "Sodium Compatibility Studies of Low Friction Carbide Coatings for Reactor Application", Paper No. 17, by G. A. Whitlow et al, Corrosion/74, Chicago, Ill., Mar. 4–8, 1974 discusses the effects of thermal cycling, compatibility with sodium, etc. on a variety of coatings including the detonation gun $Cr_3C_2$+Inconel 718 coating. Inconel is a trademark of International Nickel Company for nickel alloys. Testing included thermal cycling between 800° F. and 1160° F. for 1000 hours. After such exposure, there was no spalling or other mechanical damage to the $Cr_3C_2$+Inconel 718 coating, and there was no observable microstructural change using metallography other than changes within the substrate. X-ray evaluation of the microstructures, however, showed that the as-deposited coating contained $Cr_7C_3$ plus $Cr_{23}C_6$, and that there appeared to be a conversion of $Cr_7C_3$ to $Cr_{23}C_6$ on long term exposure at elevated temperatures. The detonation gun $Cr_3C_2$+Inconel 718 coating appeared to have good self-mating adhesive wear resistance when used in liquid sodium.

In addition to liquid sodium applications, the chromium carbide base thermal spray coating family has been in use for many years to provide sliding and impact wear resistance at elevated temperatures. The most frequently used system by far is the chromium carbide plus nickel chromium composite. The nickel chromium (usually Ni—20 Cr) constituent of the coating has ranged from about 10 to about 35 wt. %. These coatings have been produced using all types of thermal spray processes including plasma spray deposition as well as detonation gun deposition. The powder used for thermal spray deposition is usually a simple mechanical blend of the two components. While the chromium carbide component of the powder is usually $Cr_3C_2$, the as-deposited coatings typically contain a preponderance of $Cr_7C_3$ along with lesser amounts of $Cr_3C_2$ and $Cr_{23}C_6$. The difference between the powder composition and the as-deposited coating is due to the oxidation of the $Cr_3C_2$ with consequent loss of carbon. Oxidation may occur in detonation gun deposition as a result of oxygen or carbon dioxide in the detonation gases, while oxidation in plasma spraying occurs as a result of inspiration of air into the plasma stream. Those coatings with a relatively high volume fraction of the metallic component have been used for self-mating wear resistance in gas turbine components at elevated temperatures. These coatings, because of the high metallic content, have good impact as well as fretting wear and oxidation resistance. At lower temperatures, coatings with nominally 20 wt. % nickel-chromium have been used for wear against carbon and carbon graphite in mechanical seals, and for wear in general in adhesive and abrasive applications. These coatings are most frequently produced by thermal spraying. In this family of coating processes, the coating material, usually in the form of powder, is heated to near its melting point, accelerated to a high velocity, and impinged upon the surface to be coated. The particles strike the surface and flow laterally to form thin lenticular particles, frequently called splats, which randomly interleaf and overlap to form the coating. The family of thermal spray coatings includes detonation gun deposition, oxy-fuel flame spraying, high velocity oxy-fuel deposition, and plasma spray.

It is an object of the present invention to provide a process of coating gas path components of turbo machines which comprises thermal spraying chromium carbide and an age hardenable nickel base alloy on the surface of the components.

It is another object of the present invention to provide a process for depositing a coating comprising chromium carbide and an age hardenable nickel base alloy, such as Inconel 718, onto a surface of a turbo machine gas path component and then heat treating the coated surface of the gas path component.

It is another object of the invention to provide an improved erosion resistant coating for gas path components of turbo machines comprising a chromium carbide plus age hardenable nickel base alloy coating.

It is another object of the invention to provide a heat treated thermal spray deposited $Cr_3C_2$+Inconel 718 coating for a gas path component of turbo machines.

The foregoing and additional objects will become more apparent from the description and disclosure hereinafter set forth.

SUMMARY OF THE INVENTION

The invention relates to a process for coating a surface of a gas path component of a turbo machine with a coating composed of chromium carbide and an age hardenable nickel base alloy comprising the step of thermal spraying a powder composition of chromium carbide and an age hardenable nickel base alloy onto at least a portion of the surface of a gas path component of a turbo machine.

Preferably, the as-deposited coated layer on the gas path component would be heated at a temperature and time period sufficient to cause precipitation of intermetallic compounds within the nickel base alloy constituent of the coated layer. In the heat treatment step, there is a transformation of the highly stressed microcrystalline as-deposited structure to a more ordered structure in which the phases exhibit well defined X-ray diffraction patterns.

As used herein, a gas path component shall mean a component that is designed to be contacted by a gas stream and used to confine the gas stream or change the direction of the gas stream in a turbo machine. Typical turbo machines are gas turbines, steam turbines, turbo expanders and the like. The component of the turbo machines to be coated can be the blades, vanes, duct segments, diaphragms, nozzle blocks and the like.

Gas path components can be subjected to erosive wear from solid particles of various sizes entrained in gas streams contacting such components at various angles. In many designs of turbo machines, the principal angle of impingement of solid particles onto the gas path components is low with angles of 10° to 30° being common. Therefore, the life of gas path components subjected to erosive wear is determined by the low angle wear resistance of the surfaces to particle impingement at these angles. The chromium carbide constituent of the coating provides good erosion resistance while the age hardenable nickel base alloy constituent of the coating provides resistance to thermal and mechanical stresses to the coating. It is expected that the age hardenable nickel base alloy would not effectively contribute to or increase the erosion resistance of the coating particularly at low angles of impingement. However, it was unexpectedly found that the addition of the age hardenable nickel base alloy not only provided thermomechanical strength to the coating but also increased the erosion resistance of the coating; particularly at low angles of impingement. This increased erosion resistance of the coating is particularly important for gas path components since erosive wear can reduce the overall dimensions of the components thereby rendering the turbo machine less efficient in its intended use. This is particularly true for blades of steam and gas turbines.

As used herein, an age hardenable nickel base alloy shall mean a nickel base alloy that can be hardened by heating to cause a precipitation of an intermetallic compound from a supersaturated solution of the nickel base alloy. The intermetallic compound usually contains at least one element from the group consisting of aluminum, titanium, niobium and tantalum. Preferably the element should be present in an amount from 0.5 to 13 weight percent, more preferably from 1 to 9 weight percent of the coating. The preferred age hardenable nickel base alloy is Inconel 718 which contains about 53 weight percent nickel, about 19 weight percent iron, about 19 weight percent chromium, with the remainder being about 3 weight percent molybdenum, about 5 weight percent niobium with about 1 weight percent tantalum and minor amounts of other elements. Inconel 718 when heated can be strengthened by nickel intermetallic compounds precipitating in an austenitic (fcc) matrix. Inconel 718 is believed to deposit a nickel-niobium compound as the hardening phase. For age hardening alloys precipitation starts at about 1000° F. and generally increases with increasing temperature. However, above a certain temperature, such as 1650° F., the secondary phase may go back into solution. The resolutioning temperature for Inconel 718 is 1550° F. (843° C.). Typical aging temperatures for Inconel 718 are from 1275° F. to 1400° F. (691° C.-760° C.) with the generally preferred temperature being 1325° F. (718° C.). Generally for nickel base alloy the age hardening temperature would be from 1000° F. to 1650° F. and preferably from 1275° F. to 1400° F. The time period of the heating treatment could generally be from at least 0.5 hour to 22 hours, preferably from 4 to 16 hours.

Suitable chromium carbide are $Cr_3C_2$, $Cr_{23}C_6$, $Cr_7C_3$, with $Cr_3C_2$ being the preferred. Deposited coatings of $Cr_3C_2$ plus Inconel 718 have been examined by X-ray evaluation of the microstructure and found to consist predominantly of $Cr_7C_3$ plus $Cr_{23}C_6$. It is believed that on long term exposure at elevated temperatures, the $Cr_7C_3$ may be converted to $Cr_{23}C_6$. For most applications, the chromium in the chromium carbide should be from 85 to 95 weight percent, and preferably about 87 weight percent.

For most applications, the weight percent of the chromium carbide component of the coating could vary from 50 to 95 weight percent, preferably from 70 to 90 weight percent and the age hardenable nickel base alloy could vary from 5 to 50 weight percent, preferably from 10 to 30 weight percent of the coating.

Flame plating by means of detonation using a detonating gun can be used to produce coatings of this invention. Basically, the detonation gun consists of a fluid-cooled barrel having a small inner diameter of about one inch. Generally a mixture of oxygen and acetylene is fed into the gun along with a coating powder. The oxygen-acetylene fuel gas mixture is ignited to produce a detonation wave which travels down the barrel of the gun whereupon the coating material is heated and propelled out of the gun onto an article to be coated. U.S. Pat. No. 2,714,563 discloses a method and apparatus which utilizes detonation waves for flame coating. The disclosure of this U.S. Pat. No. 2,714,563 is incorporated herein by reference as if the disclosure was recited in full text in this specification.

In some applications it may be desirable to dilute the oxygen-acetylene fuel mixture with an inert gas such as nitrogen or argon. The gaseous diluent has been found to reduce the flame temperature since it does not participate in the detonation reaction. U.S. Pat. No. 2,972,550 discloses the process of diluting the oxygen-acetylene fuel mixture to enable the detonation-plating process to be used with an increased number of coating compositions and also for new and more widely useful applications based on the coating obtainable. The disclosure of this U.S. Pat. No. 2,972,550 is incorporated herein by reference as if the disclosure was recited in full text in this specification.

In other applications, a second combustible gas may be used along with acetylene, such gas preferably being propylene. The use of two combustible gases is disclosed in U.S. Pat. No. 4,902,539 which is incorporated herein by reference as if the disclosure was recited in full text in this specification.

Plasma coating torches are another means for producing coatings of various compositions on suitable substrates according to this invention. The plasma coating technique is a line-of-sight process in which the coating powder is heated to near or above its melting point and accelerated by a plasma gas stream against a substrate to be coated. On impact the accelerated powder forms a coating consisting of many layers of overlapping thin lenticular particles or splats. This process is also suitable for producing coatings of this invention.

Another method of producing the coatings of this invention may be the high velocity oxy-fuel, including the so-called hypersonic flame spray coating processes. In these processes, oxygen and a fuel gas are continuously combusted thereby forming a high velocity gas stream into which powdered material of the coating composition is injected. The powder particles are heated to near their melting point, accelerated, and impinged upon the surface to be coated. Upon impact the powder particles flow outward forming overlapping thin, lenticular particles or splats.

The chromium carbide powders of the coating material for use in obtaining the coated layer of this invention are preferably powders made by the sintering and crushing process. In this process, the constituents of the powders are sintered at high temperature and the resultant sinter product is crushed and sized. The metallic powders are preferably produced by argon atomization followed by sizing. The powder components are then blended by mechanical mixing.

Sample coatings of this invention were produced and then subjected to various tests along with samples of coatings that were not heat treated and/or did not contain an age hardenable nickel base alloy. A brief description of the various tests are described in conjunction with the specific examples.

TEST I. FINE CHROMITE EROSION TEST AT ROOM TEMPERATURE

To demonstrate the superior erosion resistance of the coatings of this invention, an erosion test was run using fine chromite ($FeCr_2O_4$) as the erodent. For this testing, type 304 stainless steel panels, 25.4 mm wide, 50.8 mm long, and 1.6 mm thick, were coated on one 25.4×50.8 mm face with the coating of interest. The coatings were nominally 150 micrometers thick. To test the coatings, the panels were placed at a distance of 101.6 mm from a 2.19 mm diameter airjet at an angle of 20° from the surface of the panel, with the airjet aligned along the long axis of the panel. Air was fed to the jet at a pressure of 32 psig (0.22 $MN/m^2$). 1200 grams of the fine chromite erodent was aspirated into the airjet at a rate such that all of the material was consumed in 100–110 seconds. The amount of erosion of the coating caused by the impinging fine chromite particles was measured by weighing the panel before and after the test. The erosion rate was expressed as weight change per gram of erodent. A similar test was run at an angle of impingement of 90° with all the parameters and procedures the same with the exception that only 600 grams of material were fed to the airjet.

EXAMPLE 1

To evaluate the efficacy of the coatings of this invention in resisting the erosion by very fine particles, similar to those found in many industrial applications, Test I was used. In this test, the erodent material is a fine chromite ($FeCr_2O_4$), a material similar to the material that exfoliates from heat exchangers in fossil fuel electric power utilities. This material becomes entrained in the steam and causes solid particle erosion of the turbine. In this test, chromium carbide-nickel chromium coatings were compared with a coating of this invention, chromium carbide-Inconel 718, in both the as-coated and in the heat treated condition. Coatings about 150 micrometers thick were deposited on a type 304 stainless steel substrate using a detonation gun process. The starting coating powder for Coating A in Table 1 was 11% Inconel 718 and 89% chromium carbide. The starting powder for Coating B in Table 1 was 11% Ni20Cr and 89% chromium carbide. Heat treatment, in this example, was for 8 hours at 718° C. in vacuum. As can be seen in the data of Test I as shown in Table 1, there is no significant difference in the performance of the two coatings in the as-coated condition at either 20° or 90° angle of impingement in the fine chromite test at room temperature. However, it can be readily seen that in the heat treated condition, the coating of this invention (Coating A) is substantially superior to that of Coating B at both 20° C. at 90° angles of impingement.

TABLE 1

| Coating Sample | Composition wt. % | HT TRT hrs/°C. | Rate @ 20° ug/g as ctd | Rate @ 20° ug/g ht trtd | Rate @ 90° ug/g as ctd | Rate @ 90° ug/g ht trtd |
|---|---|---|---|---|---|---|
| A | 16 [IN 718] + 84 [CrCarbide] | 8/718 | 18 | 3 | 28 | 2 |
| B | 20 [80Ni20Cr] + 80 [CrCarbide] | 8/718 | 17 | 6 | 23 | 9 |

TEST II. COARSE CHROMITE EROSION TEST AT ELEVATED TEMPERATURE

To demonstrate the superior erosion resistance of the coatings of this invention, an erosion test was run with both the coating and the erodent maintained at a temperature of nominally 550° C. For this testing, type 304 stainless steel panels 4.0 mm thick were coated on a 25.4 mm long, 12.7 mm wide face with the coating of interest. The coatings were nominally 250 micrometers thick. To test the coatings, the panels were mounted at one end of a heated tunnel 89 mm by 25.4 mm in cross-section and 3.66 m long at the other end of which was mounted a combustor which produced a stream of hot gas sufficient to heat the sample coatings to the aforementioned test temperature. Relatively coarse chromite erodent of 75 micrometers nominal diameter was introduced into the combustor exhaust stream such that it achieved a velocity of nominally 228 meters per second before it impinged on the surface of the coating. The angle of impingement was varied by mechanically adjusting the aspect angle of the coated specimen. The amount of erosion caused by the impinging chromite particles was measured by weighing the panel before and after the test. The erosion rate was expressed as weight change per gram of erodent that impinged on the sample.

EXAMPLE 2

To assess the value of the coatings of this invention in erosion resistance at elevated temperatures, Test II was used. In this test, a somewhat coarser chromite material of the same chemical composition, but larger particle size was used than the Test I used in Example 1. In this test, Coating A (80 wt. % chromium carbide plus 20 wt. % nickel chromium) and Coating C (65 wt. % chromium carbide plus 35 wt. % nickel chromium) were compared with a coating of this invention, Coating B (78 wt. % chromium carbide plus 22 wt. % IN-718). The coatings were applied as in Example 1 to about 250 micrometers thick. The results of this test with a particle velocity of 228 m/sec are shown in Table 2A. Similar tests were run with a particle velocity of 303 m/sec, as shown in Table 2B. From the data, it is quite evident that the coating of this invention (Coating B) is better than Coatings A and C with a particle velocity of 228 m/sec (Table 2A) at all angles of impingement and superior at an angle of impingement of 15°. At a particle velocity of 303 m/sec (Table 2B) the coating of this invention (Coating B) was superior to Coatings A and C in the coarse chromite erosion test at an angle of impingement of 15°.

TABLE 2A

| Coating Sample | Composition wt. % | Rates - micrograms loss/g erodent Angle of Attack 15° | 30° | 50° | 70° | 90° |
|---|---|---|---|---|---|---|
| A | 20 [80Ni20Cr]° + | 880 | 1410 | 1560 | 1680 | 1730 |

TABLE 2A-continued

| Coating Sample | Composition wt. % | Rates - micrograms loss/g erodent Angle of Attack 15° | 30° | 50° | 70° | 90° |
|---|---|---|---|---|---|---|
| B | 80 [CrCarbide] 22 [IN 718] + 78 [CrCarbide] | 600 | 1200 | 1350 | 1460 | 1500 |
| C | 35 [80Ni20Cr] + 65 [CrCarbide] | 950 | 1740 | 1920 | 2000 | 2020 |

*Particle size of metallic fraction is smaller than in Coatings B and C.

TABLE 2B

| Coating Sample | Composition wt. % | Rates - micrograms loss/g erodent Angle of Attack 15° | 30° | 50° | 70° | 90° |
|---|---|---|---|---|---|---|
| A[1] | 20 [80Ni20Cr]* + 80 [CrCarbide] | 1630 | 2200 | 2840 | 3120 | 3190 |
| B[2] | 22 [IN 718] + 78 [CrCarbide] | 1130 | 2520 | 2700 | 3020 | 3050 |
| C[3] | 35 [80Ni20Cr] + 65 [CrCarbide] | 2620 | 3270 | 3730 | 3830 | 4030 |

*Particle size of metallic fraction is smaller than in Coatings B and C.
[1]Starting powder contains 11% (80 nickel-20 chromium), 89% $Cr_3C_2$.
[2]Starting powder contains 11% Inconel 718, 89% $Cr_3C_2$.
[3]Starting powder contains 25% (80 nickel-20 chromium), 75% $Cr_3C_2$.

TEST III. COARSE ALUMINA EROSION TEST AT ROOM TEMPERATURE

To demonstrate the superior erosion resistance of the coatings of this invention, an erosion test was run using relatively coarse angular alumina as the erodent. For this testing, type 304 stainless steel panels, 25.4 mm wide, 50.8 mm long, and 1.6 mm thick, were coated on one 25.4×50.8 mm face with the coating of interest. The coatings were nominally 150 micrometers thick. To test the coatings, the panels were placed at a distance of 101.6 mm from a 2.19 mm diameter airjet at an angle of 20° from the surface of the panel, with the airjet aligned along the long axis of the panel. Air was fed to the jet at a pressure of 32 psig (0.22 $MN/m^2$). 600 grams of the alumina erodent was aspirated into the airjet at a rate such that all of the material was consumed in 100–110 seconds. The amount of erosion of the coating caused by the impinging alumina particles was measured by weighing the panel before and after the test. The erosion rate was expressed as weight change per gram of erodent. A similar test was run at an impingement angle of 90° with all the parameters and procedures the same with the exception that only 300 grams of material were fed to the airjet.

EXAMPLE 3

In this test, relatively large alumina particles are used at room temperature. Testing was done using Test III at both 20° and 90° angles of impingement with the coatings either as-coated or heat-treated as shown in Table 3. The heat treatment in this example was either 8 hours in vacuum at 718° C. or 8 hours in air at 718° C. The coatings were applied as in Example 1 to a thickness of 150 micrometers and the starting and final composition of the powders and coated layers, respectively, are shown in Table 3. From the data, it is evident that in the as-coated condition, there is little difference between the three coatings when tested with coarse alumina at room temperature. The heat-treated coatings at an angle of impingement of 90° showed an improvement. However, at an angle of impingement of 20°, there is a substantial improvement between the coatings of this invention (Coatings A and B) and that of the prior art (Coating C). This is a very significant finding since most erosion in industry occurs at low angles, not high angles.

The coating of Sample Coating A that was heated in vacuum was further heated for 72 hours at 718° C. in air which is considered overaging of the coating. However, the erosion rate at 20° was found to be 57 ug/g and the erosion rate at 90° was found to be 78 ug/g. The improved coating performance was retained despite overaging which could occur due to service exposure.

TABLE 3

| Coating Sample | Composition wt. % | HT TRT Atmosphere | Rate @ 20° ug/g as ctd | Rate @ 20° ug/g ht trtd | Rate @ 90° ug/g as ctd | Rate @ 90° ug/g ht trtd |
|---|---|---|---|---|---|---|
| A | 16 [IN 718][1] + 84 [CrCarbide] | Air | 99 | 49 | 114 | 80 |
| | | Vacuum | 109 | 70 | 122 | 96 |
| B | 20 [IN 718][1] + 80 [CrCarbide] | Air | 114 | 61 | 114 | 92 |
| C | 20 [80Ni20Cr][2] + 80 [CrCarbide] | Vacuum | 111 | 92 | 110 | 119 |

[1]Starting powder contains 11% IN 718, 89% chromium carbide
[2]Starting powder contains 11% (80 nickel-20 chromium), 89% chromium carbide

EXAMPLE 4

In this example, the effect of the amount of the metallic phase in three coatings of this invention were compared using Test III. Coatings 150 micrometers thick in both the as-coated and heat-treated conditions were evaluated. The heat treatment in this case was 8 hours in vacuum at 718° C. The results are shown in Table 4. With an angle of impingement of 90°, there is little difference in performance between the three coatings in either the as-coated or heat-treated condition. With an angle of impingement of 20°, there appears to be a slight increase in erosion rates with an increase in the metallic phase in either the as-coated or heat-treated condition. This increase, however, is not very great. It is evident, therefore, that the coatings of this invention have great utility over a wide range of metallic phase content.

TABLE 4

| Coating Sample | Composition wt. % | Rate @ 20° ug/g as ctd | Rate @ 20° ug/g ht trtd | Rate @ 90° ug/g as ctd | Rate @ 90° ug/g ht trtd |
|---|---|---|---|---|---|
| A | 8 [IN 718] + 92 [CrCarbide][1] | 96 | 58 | 135 | 94 |
| B | 16 [IN 718] + 84 [CrCarbide][2] | 109 | 70 | 122 | 96 |
| C | 27 [IN 718] + 23 [CrCarbide][3] | 117 | 74 | 129 | 97 |

[1]Starting Powder contains 5.5% IN 718, 95.5% chromium carbide
[2]Starting Powder contains 11% IN 718, 89% chromium carbide
[3]Starting Powder contains 16.5% IN 718, 83.5% chromium carbide

TEST IV. FINE ALUMINA EROSION TEST AT ELEVATED TEMPERATURE

To demonstrate the superior erosion resistance of the coatings of this invention, an erosion test was run with both the coating and the erodent maintained at a temperature of nominally 500° C. For this testing, type 410 stainless steel blocks 12.7 mm thick were coated on a 34 mm long, 19 mm wide face with the coating of interest. The coatings were nominally 250 micrometers thick. To test the coatings, the blocks were mounted in an enclosure filled with inert gas into which a stream of alumina particles of 27 micrometer nominal size suspended in inert gas could be introduced through a 1.6 mm diameter, 150 mm long nozzle made of cemented carbide. The coated samples were positioned 20 mm from the exit end of this nozzle, oriented at angles of 90° or 30° to the centerline of the nozzle. The enclosure was placed within a furnace which heated the coated samples to a temperature of 500° C. While they were at this temperature they were subjected to the impact of a known mass of alumina particles flowing at a velocity of about 94 meters per second for a fixed period of time. The maximum depth to which the coating was penetrated by the alumina particles was taken as the measure of erosion. The erosion rate was expressed as depth of penetration per gram of erodent that impinged on the sample.

EXAMPLE 5

Sample coatings 150 micrometers thick were produced as in Example 1 using the composition shown in Table 5. The data show that the erosion rate at an impingement angle of 30° for the heat treated coatings of this invention (Coatings A and B) were better than the heat treated coatings of the prior art (Coatings C and D).

TABLE 5

| Coating Sample | Composition wt/% | HT TRT hrs/°C. | Rate @ 90° (um/g) | Rate @ 30° (um/g) |
|---|---|---|---|---|
| A | 16 [IN 718] + | None | 145 | 85 |
| | 84 [CrCarbide][1] | 72/550 | 136 | 67 |
| | | 16/718 | 157 | 61 |
| B | 20 [IN 718] + | None | 172 | 82 |
| | 80 [CrCarbide][1] | 72/550 | 186 | 68 |
| | | 16/718 | 165 | 72 |
| C | 20 [80Ni20Cr] + | None | 183 | 79 |
| | 80 [CrCarbide][2] | 72/550 | 171 | 110 |
| D | 20 [80Ni20Cr] + | None | 170 | 89 |
| | 80 [CrCarbide][2] | 72/550 | 199 | 92 |

[1]Starting Powder contains 11% IN 718, 89% chromium carbide
[2]Starting Powder contains 11% Nichrome, 89% chromium carbide The heat-treated chromium carbide plus nickel base age hardenable alloy coating of this invention is ideally suited for use in gas path components of turbo machines. The thickness of the coating can vary from 5 to 1000 microns thick for most applications with a thickness between about 15 and 250 microns being preferred. Suitable substrates for use in this invention would include nickel base alloys, cobalt base alloys, iron base alloys, titanium base alloys and refractory base alloys.

The heat treatment step of this invention could be performed following the coating deposition step at the same facility or the coated gas path component could be installed on or to a turbo machine system and then the coated component could be exposed to the heat treatment step. If the intended environment of the coated component is compatible to the heat treatment step, then the coated component could be heat treated in its intended environment. For example, the coated component, such as a blade, could be exposed to an elevated temperature in its intended environment and the heat treatment step could be performed in such an environment provided the environment is compatible to the condition of the heat treatment step. Thus the heat treatment step does not need to be performed immediately after the coating deposition step or at the same facility.

While the examples above use detonation gun means to apply the coatings, coatings of this invention may be produced using other thermal spray technologies, including, but not limited to, plasma spray, high velocity oxy-fuel deposition, and hypersonic flame spray.

As many possible embodiments may be made of this invention without departing from the scope thereof, it being understood that all matter set forth is to be interpreted as illustrative and not in a limiting sense.

What is claimed is:

1. A process for coating a surface of a turbo machine gas path component with a coating component of chromium carbide and an age hardenable nickel base alloy comprising the step of thermal spraying a powder composition of chromium carbide and an age hardenable nickel base alloy onto at least a portion of a surface of a gas path component of a turbo machine and then heating the as-deposited coating at a temperature sufficient to cause precipitation of intermetallic components within the nickel base alloy constituent of the coating to produce a heat treated chromium carbide-age hardened nickel base alloy coating on said portion of the surface of the gas path component of the turbo machine in which said chromium carbide in the heat treated coating comprises $Cr_7C_3$ plus $Cr_{23}C_6$ and wherein the chromium carbide comprises from 50 to 95 weight percent of the coating and the age hardened nickel base alloy comprises from 5 to 50 weight percent of the coating.

2. The process of claim 1 wherein the as-deposited coating is heated at a temperature from 1000° F. to 1650° F. for a time period between 0.5 to 22 hours.

3. The process of claim 2 wherein the temperature is from 1275° F. to 1400° F. for a time period from 4 to 16 hours.

4. The process of claim 1 or 2 wherein the age hardenable nickel base alloy contains about 53 weight percent nickel, about 19 weight percent chromium, about 19 weight percent iron, about 3 weight percent molybdenum, about 5 weight percent niobium, and about 1 weight percent tantalum.

5. The process of claim 1 wherein the chromium carbide comprises from 70 to 90 weight percent of the coating and the age hardenable nickel base alloy is from 10 to 30 weight percent of the coating.

6. The process of claim 1 wherein the gas path component of the turbo machine is selected from the group consisting of blades, vanes, duct segments and diaphragms.

7. The process of claim 1 wherein the turbo machine is a turbine.

8. A turbo machine having a gas path component coated with a chromium carbide and an age hardened nickel base alloy composition in which the chromium carbide comprises $Cr_7C_3$ plus $Cr_{23}C_6$ and wherein the chromium carbide comprises from 50 to 95 weight percent of the coating and the age hardened nickel base alloy comprises from 5 to 50 weight percent of the coating.

9. The turbo machine of claim 8 wherein the machine is a turbine.

10. The turbo machine of claim 8 wherein the gas path component is a blade.

11. The turbo machine of claim 8 wherein the gas path component is a vane.

12. The turbo machine of claim 8 wherein the gas path component is a diaphragm.

13. The turbo machine of claim 8 wherein the gas path component is a nozzle block.

* * * * *